US006260823B1

(12) United States Patent
Weber

(10) Patent No.: US 6,260,823 B1
(45) Date of Patent: Jul. 17, 2001

(54) LIQUID CONTAINER FOR DRINKS, SUCH AS A CAN, PARTY KEG OR DRUM

(75) Inventor: Hans-Joachim Weber, Lorch (DE)

(73) Assignee: Huber Verpackungen GmbH&Co., Dehringen (DE)

( * ) Notice: Subject to any disclaimer, the term of this patent is extended or adjusted under 35 U.S.C. 154(b) by 0 days.

(21) Appl. No.: 09/029,384

(22) PCT Filed: Oct. 30, 1996

(86) PCT No.: PCT/DE96/02075

§ 371 Date: May 13, 1999

§ 102(e) Date: May 13, 1999

(87) PCT Pub. No.: WO97/16350

PCT Pub. Date: May 9, 1997

(30) Foreign Application Priority Data

Oct. 31, 1995 (DE) ..... 195 40 542

(51) Int. Cl.[7] ..... B67D 3/04; B67D 5/33

(52) U.S. Cl. ..... 251/351; 222/153.07; 222/523; 222/481.5

(58) Field of Search ..... 251/349, 351; 222/153.07, 522, 523, 538, 481.5

(56) References Cited

U.S. PATENT DOCUMENTS

| | | | | |
|---|---|---|---|---|
| 1,744,216 | * | 1/1930 | Draper | 251/351 |
| 2,791,236 | * | 5/1957 | Mauer | 251/351 |
| 2,992,763 | | 7/1961 | Huertas . | |
| 3,348,848 | | 10/1967 | Lucking . | |
| 3,386,632 | * | 6/1968 | Sager | 251/351 |
| 4,802,610 | * | 2/1989 | Cheek et al. | 222/481.5 |
| 5,267,669 | | 12/1993 | Dixon et al. . | |

FOREIGN PATENT DOCUMENTS

| | | |
|---|---|---|
| 210136 | 10/1907 | (DE) . |
| 554131 | 3/1930 | (DE) . |
| 1147168 | 4/1963 | (DE) . |
| 1482588 | 4/1969 | (DE) . |
| 2657810 | 6/1978 | (DE) . |
| 7924993 | 9/1979 | (DE) . |
| 8525319 U | 9/1985 | (DE) . |
| 8608406 U | 3/1986 | (DE) . |
| 8631318 U | 11/1986 | (DE) . |
| 3925661A1 | 1/1991 | (DE) . |
| 9203958 U | 3/1992 | (DE) . |
| 0 041 874 B1 | 12/1981 | (EP) . |
| 0256253 | 2/1988 | (EP) . |
| 0350243 | 1/1990 | (EP) . |
| 16806 | 4/1913 | (FR) . |
| 894079 | 12/1944 | (FR) . |
| 252483 | 6/1926 | (GB) . |
| 270361 | 5/1927 | (GB) . |
| 2138109 | 10/1984 | (GB) . |
| 5221462 | 8/1993 | (JP) . |
| 9603325A2 | 2/1996 | (WO) . |
| 9603331A1 | 2/1996 | (WO) . |
| 96/13438 | 5/1996 | (WO) . |

OTHER PUBLICATIONS

Patent Abstracts of Japan, vol. 017, No. 667 (M–1524) Dec. 9, 1993 & JP 05 221462 A (Hideaki Hatake), Aug. 31, 1993.

* cited by examiner

*Primary Examiner*—John Rivell
(74) *Attorney, Agent, or Firm*—Paul Vincent

(57) ABSTRACT

The invention concerns a liquid container for drinks such as a can, party keg or drum, having a peripheral wall (1,13,31) and lids (14,32). A tap (4,15,34) with a closed and opened position is inserted in a hole (27,33) in the wall (1,13,31) or in one of the lids (14,32). The tap extends into the interior of the container and comprises an outer part (6,16,35) which is fixed to the wall or lid and an inner part (5,17,36) which can move within the fixed part and is provided outside the container with a grip (8,26,41). The hole (27) can be located in the wall (1) or lid (14) in a recess (3) in which, when the tap (4,15) is in the closed position, the grip (8,26) attached to the inner part (5,17) of the tap is countersunk.

12 Claims, 7 Drawing Sheets

LIQUID CONTAINER FOR DRINKS, SUCH AS A CAN, PARTY KEG OR DRUM

BACKGROUND OF THE INVENTION

The invention concerns a liquid container tap for drinks such as a can, a party keg or a drum in particular made from tin plate, aluminum or plastic, consisting essentially of an outer tube and an inner tube disposed within the outer tube in a displaceable and/or rotatable manner and having a grip, the inner tube, in its closed position, being at least partially and preferentially completely or almost completely displaced into the outer tube, the outer tube having an inlet opening which, in the closed position of the tap with the inner tube inserted into the outer tube, is closed by same, the inner tube having a longitudinal channel with an outlet opening and an inlet opening which, in the opened position of the tap with the inner tube pulled out of the outer tube coincides with the inlet opening of the outer tube to free the longitudinal channel.

Beverage cans for beer or beer kegs as well as for other beverages normally have a pre-stamped opening seal. So-called party kegs for beer having a volume between two and ten liters are becoming increasingly prevalent today. A special separate tap must be used to first open and then empty these kegs. It has turned out that this tap, which must be subsequently connected to the party keg or can, is disadvantageous, since a certain amount of dexterity is required to introduce the tap into the can or into the party keg, in particular, when the contents are not to be shaken. A separate tap can also become lost and be missing at an important moment.

Known in the art from French patent manuscript FR 894 079 A is a tap for emptying liquid from a container. The conventional tap consists essentially of an outer tube and an inner tube disposed for longitudinal displacement within the outer tube. A liquid can flow from the inside of a container through the inner tube when the inner tube is sufficiently pulled out of the outer tube to at least partially align an opening in the wall of the inner tube with an opening in the outer tube at which the fluid is located, with an inner tube outlet opening disposed on the other end outside of the container.

When the flow of fluid is to be interrupted, the inner tube is pushed into the outer tube and the opening in the wall of the inner tube is covered by the inner peripheral surface of the outer tube and sealed in a liquid-tight fashion.

A protrusion is mounted to the outer wall of the container and can include a sealing band. Before the conventional tap is opened for the first time, the sealing band is securely connected to both the outer wall of the container as well as to the tap. Before the tap can be opened for the first time, the sealing band must first be destroyed. In the event that the seal band is intact, the user knows that the container is still in its original filled state.

SUMMARY OF THE INVENTION

It is the purpose of the present invention to create a seal for a container, prior to the first use thereof, which permanently indicates the sealed state and which is simple and economical to produce without incorporating the outer wall of the container.

This purpose is achieved in that a tap having a closed and opening position is inserted into a hole within the wall or one of the lids which extends into the inner portion of the liquid container. The hole in the wall or lid can be advantageously disposed in a recess of same within which, in the closed position of the tap, the grip which is firmly connected to the inner tube of the tap is countersunk. An outside member, such as a flange, is disposed on the outer tube to which a seal is attached, the seal protruding through the grip of the inner tube and having an intended breaking location which is adapted to tear-off when the grip is pulled out of its closed seating.

The tap in accordance with the invention has the advantage that it is already mounted to the liquid container by the manufacturer so that no additional preparations are required. The tap is integrated in the liquid container. In this fashion an emptying is possible at any location and at any time without auxiliary measures. The tap is mounted by the manufacturer during production of the liquid container and sealed. The tap in accordance with the invention therefore constitutes part of the liquid container. It is advantageous to introduce the hole into the wall or the lid in which the tap is disposed in a recess in the wall or in the lid wherein, in the closed position of the tap, the grip, which is connected to the inner tube of the tap, is countersunk within the recess. In this manner, protection against injury or damage due to protruding or sharp portions of the tap is prevented.

In further embodiments of the invention of the tap, the inner tube is disposed in a displaceable and/or rotationable fashion within the outer tube which, at least partially, and preferentially completely or almost completely can be inserted into the outer tube, wherein the outer tube has an inlet opening sealed in a closed position of the tap by the inner tube inserted into the outer tube, the inner tube having a longitudinal channel with an outlet opening and an inlet opening which coincides with the inlet opening of the outer tube in the open position of the tap when the inner tube is withdrawn from the outer tube for freeing the longitudinal channel.

A liquid container equipped with a tap in accordance with the invention is easily operated. After engaging the grip and destroying the seal, the inner tube of the tap is pulled out of the outer tube or screwed out thereof, wherein the fluid begins to flow during the last third or the last quarter of the path of the inner tube relative to the outer tube. Should the tap have an inner tube which is rotated out of the outer tube, this rotation is preferentially through 360 degrees, wherein fluid begins to flow approximately at an angular position between 300 and 330 degrees.

A vent valve can be advantageously disposed in one of the lid faces of the liquid container which, if appropriate, simultaneously serves as a valve for filling the container. It is also possible for the tap itself to have a vent mechanism.

DESCRIPTION OF THE PREFERRED EMBODIMENT

Figure 1:
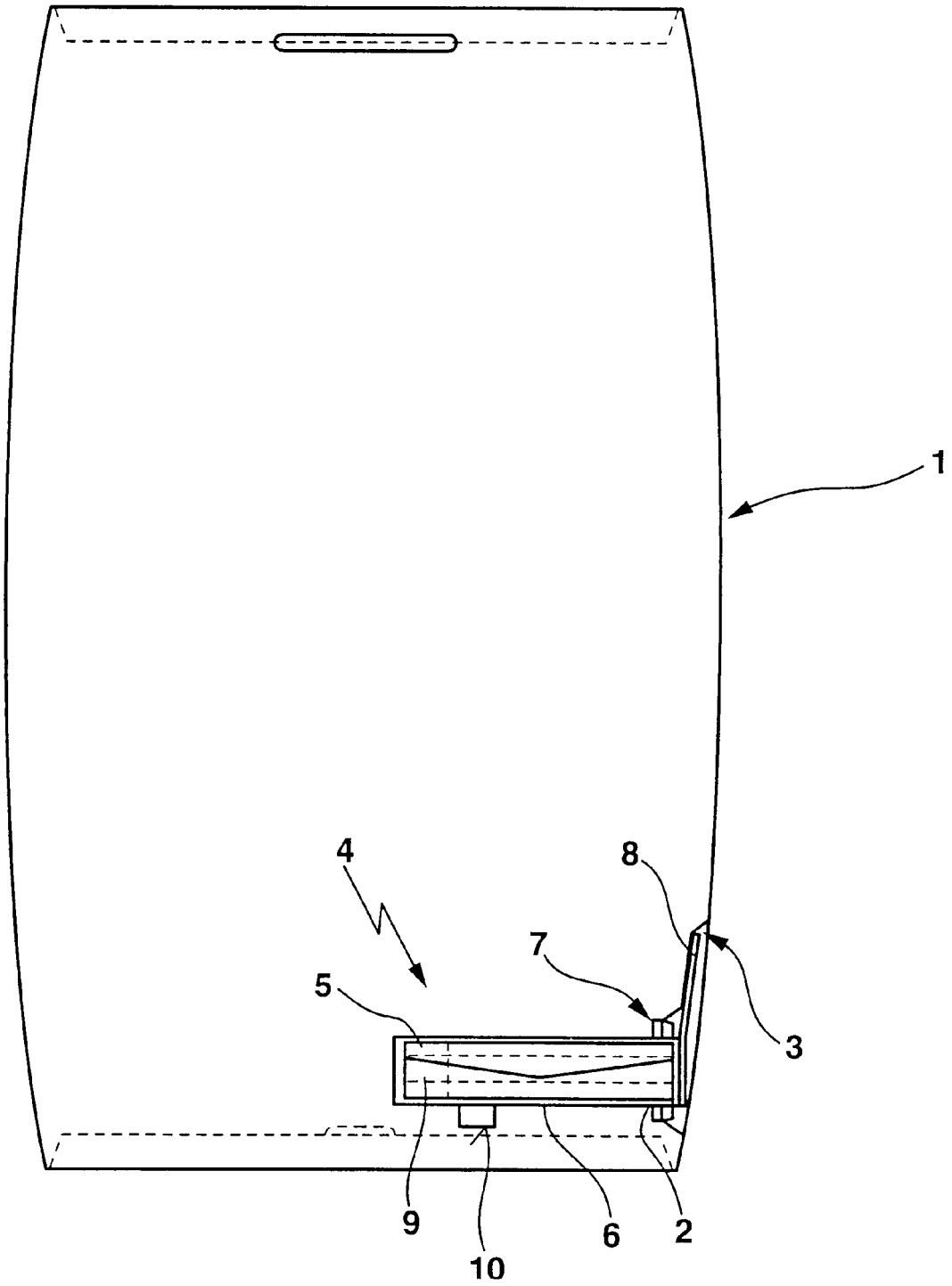
FIG. 1 shows a schematic cut through a liquid container for beverages in the form of a party keg having a built-in tap.

As seen in FIG. 1, a liquid container in the form of a party keg consists essentially of an outside wall 1, having lower and upper lids, in which a filling connector 2 is disposed. A embossed recess 3 is formed in the container wall 1 in a lower region proximate the lower lid. The recess 3 extends into the inward portion of the liquid container and has a hole 2. A ring-shaped seal 7 seats within the hole 2 through which a tap 4 penetrates into the inward portion of the liquid container, the tap consisting essentially of an outer tube 6 and an inner tube 5 disposed within the outer tube 6 for motion relative thereto. The outer tube 6 is firmly anchored within the wall of the recessed portion by the seal 7. The end of the inner tube 5 outside of the liquid container has a grip 8 which, in a closed position of the tap 4, lies completely within the recess 3. The inner tube 5 has a longitudinal channel 9 which serves for the passage of the fluid in the opened position of the tap 4.

Figure 2:
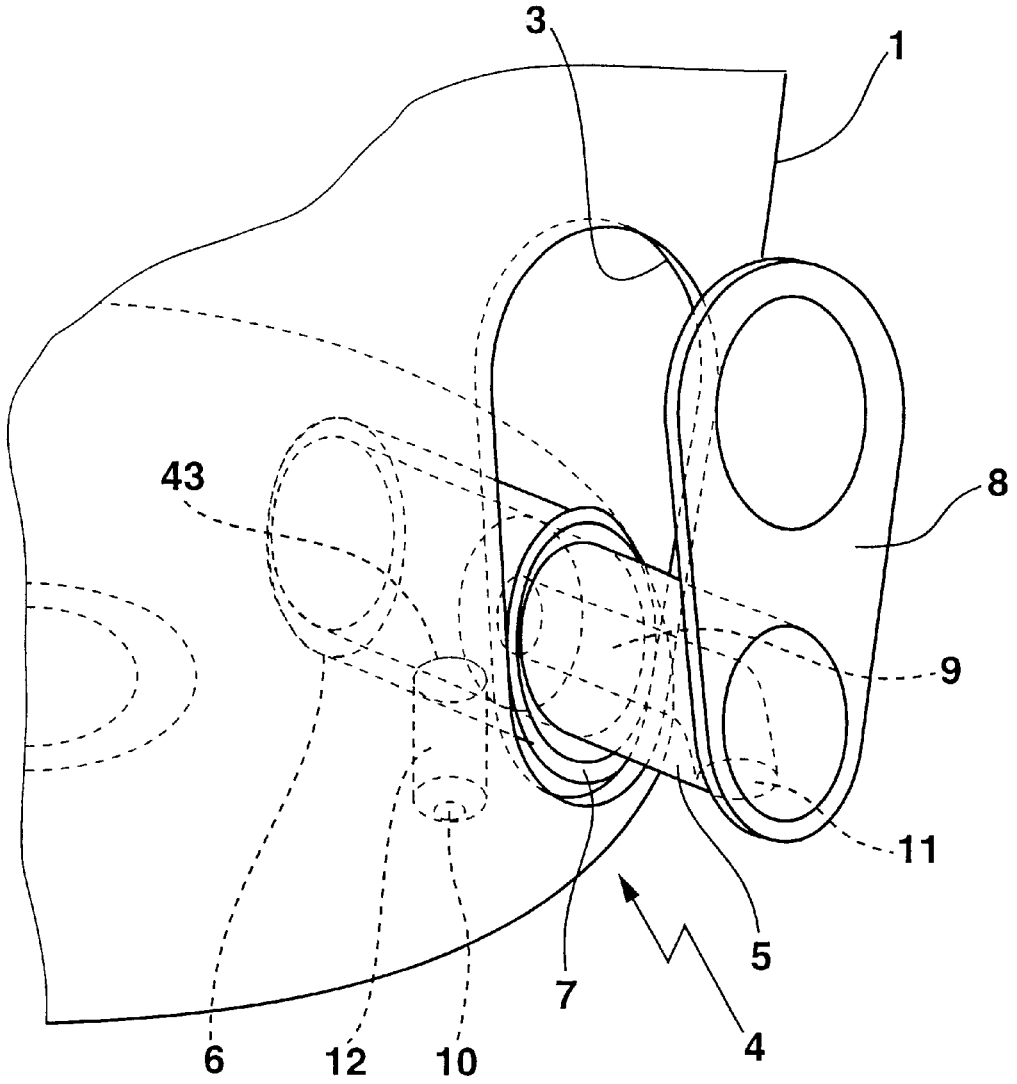
FIG. 2 shows a perspective view of the tap of FIG. 1 which is opened by a translational motion.

FIG. 2 shows a perspective view of the tap of FIG. 1. The outer tube 6 of the tap 4 is closed at its end facing away from the container wall 1 and has an inlet opening 43 into which a tubular inlet connector 12 having an inlet opening 10 is fitted to connect the outer tube 6 with the inner portion of the liquid container. A longitudinal channel 9 penetrates through the inner tube 5 and leads at one end into that end of the inner tube facing away from the container wall. The channel 9 has an outlet opening 11 situated at the protruding end of the inner tube 5 and in the side of the outer wall of the inner tube 5. In this manner, a diagonally downward flow-out direction is effected when the liquid container seats in an upright manner on a support. The grip 8 disposed on the front protruding end of the inner tube 5 is tab-shaped and has the same contour as the recess 3. The recess 3 is elongated-oval in shape, wherein the larger diameter of the recess extends approximately parallel to the middle axis of the liquid container and the hole 2 for receiving the tap 4 is disposed in the lower region of the recess 3 near the edge.

In order to open the tap, the flexible tab of the grip 8 is engaged with a finger and pulled in the forward direction out of the recess 3, wherein the inner tube 5 is moved along therewith. When the inner tube 5 is pulled out of the outer tube 6 for the first time, a seal disposed between the outer tube 6 and the inner tube 5 is irreversibly destroyed. As soon as the end of the inner tube 5 passes over the inlet opening 10 of the inlet connector 12 and the inlet opening 43 of the outer tube 6, fluid flows through the inlet connector 12 and the longitudinal channel 9 in an outward direction. When the grip is pushed towards the liquid container, the tap 4 is closed as soon as the back end of the inner tube 5 passes over the inlet openings 43 and 10. The inlet connector 12 effects complete emptying of the liquid container due to the suction effect.

Figure 3:
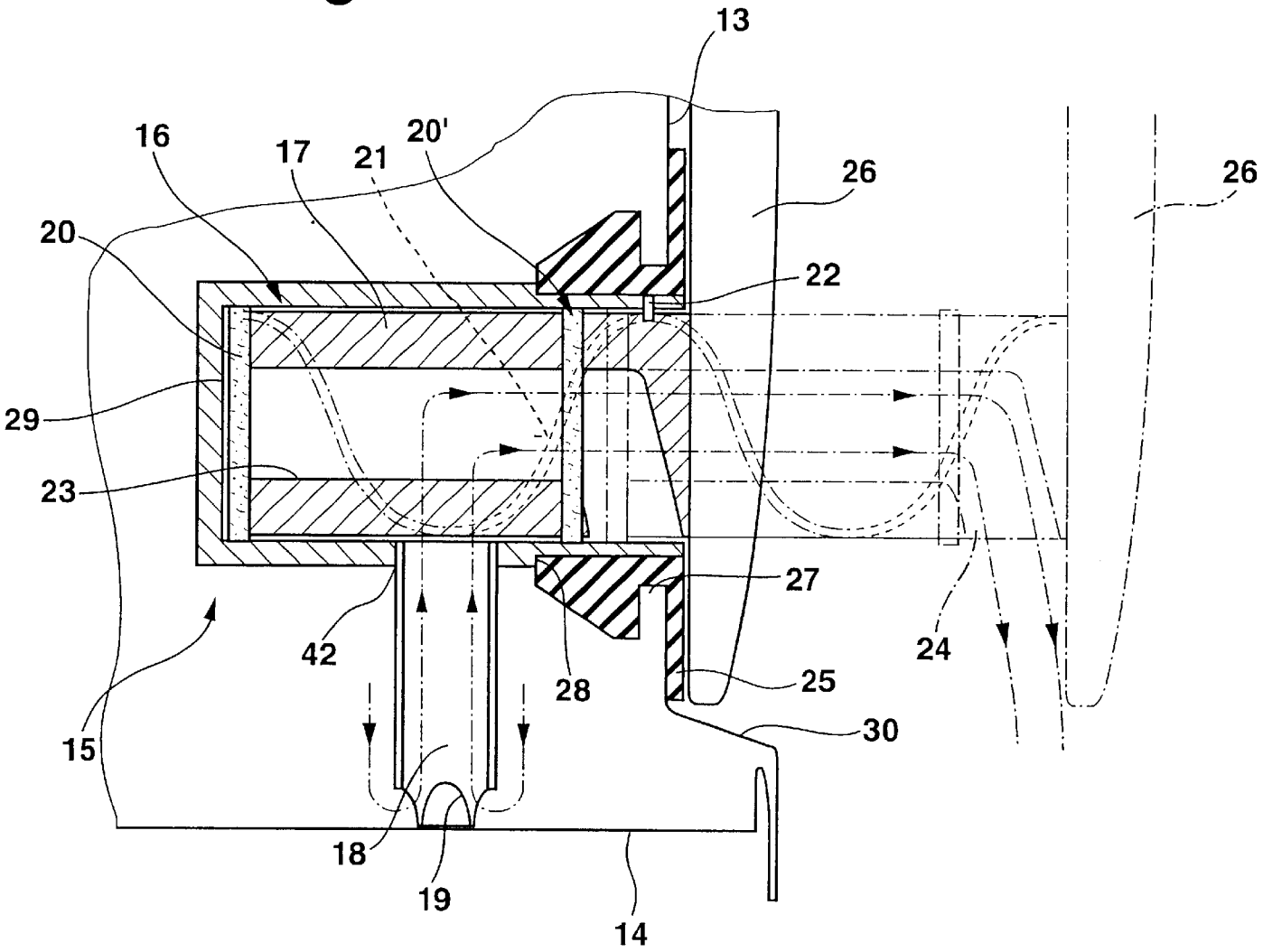
FIG. 3 shows a cut through a tap opened by means of a screw-like motion.

FIG. 3 shows a tap 15 inside of a container wall 13 which is opened and closed by a translational-rotational motion. An embossment or recess 30 is formed in the container wall 13 having a hole 27 in which a ring-shaped seal 25 seats. The seal 25 surrounds a cylindrical outer tube 16 having a peripheral shoulder 28 at which the seal 25 abuts. The outer tube 16 projects into the inside of the liquid container and is closed at its back end. A likewise cylindrical inner tube 17 is guided and fit within the outer tube 16 and has a sealing ring 20, 20' at each of its two ends for sealing with respect to the outer tube 16. The inner tube 17 has a longitudinal channel 23 which leads into the end surface of the inner tube 17 to form an inlet opening 29. The longitudinal channel 23 connects with the outer wall of the inner tube 17 at the front end facing the container wall 13, as can be seen from FIG. 3. A grip 26 is disposed on this end of the inner tube 17 and seats within the recess 30 in the closed position of the tap 15.

A guide groove 21 subtends a spiral or screw-like path about the outer wall of the inner tube 17 into which a guide pin 22 projects which is mounted inside the outer tube 16 at the front end facing the container wall 13. The outer tube 16 has, at approximately half of its length, a pipe-shaped inlet connector 18 which feeds into an inlet opening 42 in the outer tube 16 and which has sideward inlet openings 19 at its lower end. The inlet connector 18 is approximately perpendicular to the outer tube 16 and extends up to the lid 14 of the liquid container so that same can be completely emptied by the suction effect when tapped.

It is also possible to manufacture the outer tube 16 and the seal 25 as one integral piece. The outer tube 16 can then be made from a harder plastic than the seal 25.

In order to open the tap 15, the grip 26 is engaged and rotated in a clockwise direction. The guide groove 21 thereby rotates along the guide pin 22 so that the inner tube 17 is guided outwardly from the outer tube 16. When the inner tube 17 is screwed out of the outer tube 16 for the first time, a seal disposed between the outer tube 16 and the inner tube 17 is permanently destroyed. As soon as the inner end of the inner tube 17 passes by the tubular inlet connector 18, fluid flows in an outward direction. It is preferred if the guide groove 21 has a pitch such that the tap 15 is opened shortly before completing a full rotation, for example between 300 and 330 degrees, and is completely open at 360 degrees. As soon as the grip 26 is rotated back somewhat in a counter-clockwise direction, the tap 15 is once more closed. Complete rotation in the counterclockwise direction causes the grip 26 and the inner tube 17 to once more completely sink into the liquid container or into the recess 3 so that there are no longer any protruding components.

The grip 26 can in the closed state of the tap 15, snap into an embossment to thereby prevent a spontaneous opening thereof. It is preferred when the length of the tap 15 is fashioned in such a manner that the outer tube 16 ends before the middle of the liquid container. This allows the filling connector for introduction of the liquid in the brewery or in the beverage company to extend unhindered into the fluid container up to the lower lid.

In addition, the tap 15 preferentially comprises plastic approved for food product applications. The grip 26 preferentially comprises transparent plastic to allow observation of the passage of the fluid through the inner tube 17.

The inner tube 17 can have a latching connection with the outer tube 16 to prevent complete rotation of the inner tube out of the outer tube. A proper rotation of the inner tube 17 out of the outer tube is also guaranteed when the guide groove 21 does not terminate at the end surface of the inner tube 17, rather has a stop at its rear end facing away from the wall of the container.

The cylindrical outer and inner tubes can also be configured in such a manner that a rigid axle extends centered within the outer tube and has a spiral-shaped or screw-shaped outer groove. The inner tube is passed over the axle, slides in a sealed manner within the bore of the outer tube, and has a pin at its back end near the liquid container which guides within the groove. Holes for outlet of the liquid are disposed in the outer and inner tubes in accordance with FIG. 3.

Figure 4:
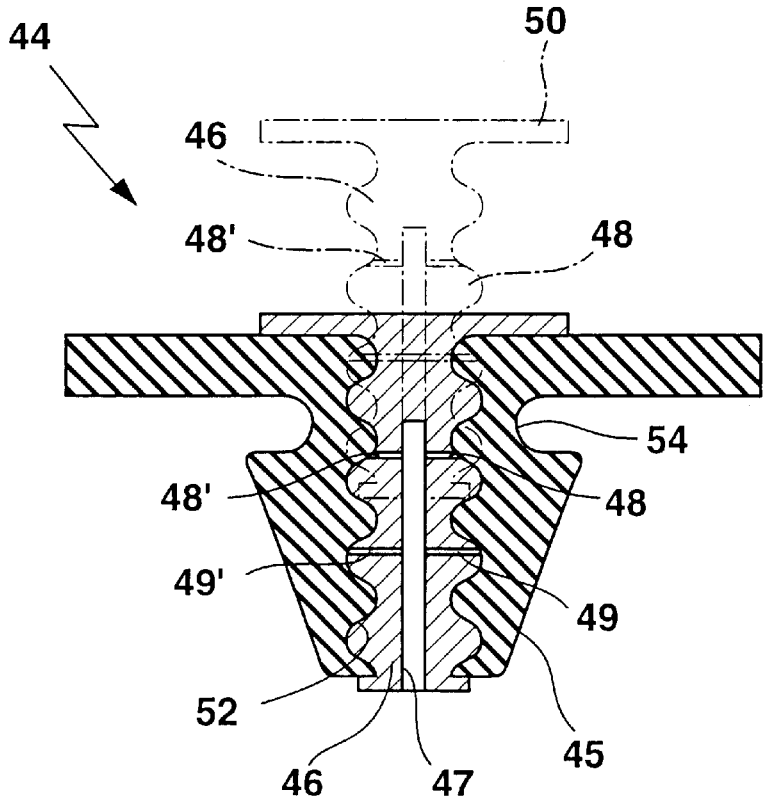
FIG. 4 shows a vent valve for venting the liquid container during dispensing.
Figure 5:
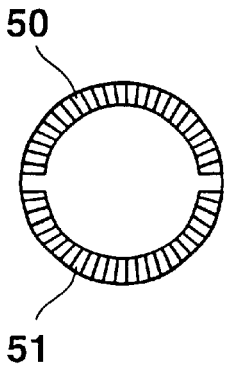
FIG. 5 shows a plan view of FIG. 4.
Figure 6:
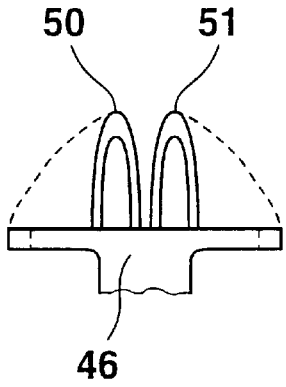
FIG. 6 shows a side view of FIG. 4 with extended pulling-rings.

FIGS. 4 through 6 show a possible venting of the liquid container during emptying using a vent valve 44 which is subdivided into a flange 53 seating on the upper portion of the liquid container and an inner ring or peg 45 having a peripheral neck 54 or which consists essentially of a ring-shaped seal. A peg 45 is preferentially conical in shape and has a through longitudinal bore 52 which can have a corrugated wall 52. A plug 46 is disposed in a movable fashion within the longitudinal bore 52 and has a correspondingly shaped outer wall, e.g. corrugated, and a bottom hole 47 facing towards the container and opened thereto which is penetrated by at least one transverse channel 48, 48', 49, 49' at its upper end inside the plug. The vent valve 44 is closed when the plug 46 is pushed-in. The liquid container is in contact with the atmosphere via the transverse channels 48, 48', 49, 49' and the bottom hole 47 when the plug 46 is partially pulled-out. The plug 46 has pulling rings 50, 51 disposed at its top outside of the liquid container which can be extended through 90 degrees for pulling the plug 46 out of the ring or peg 45.

Figure 7:
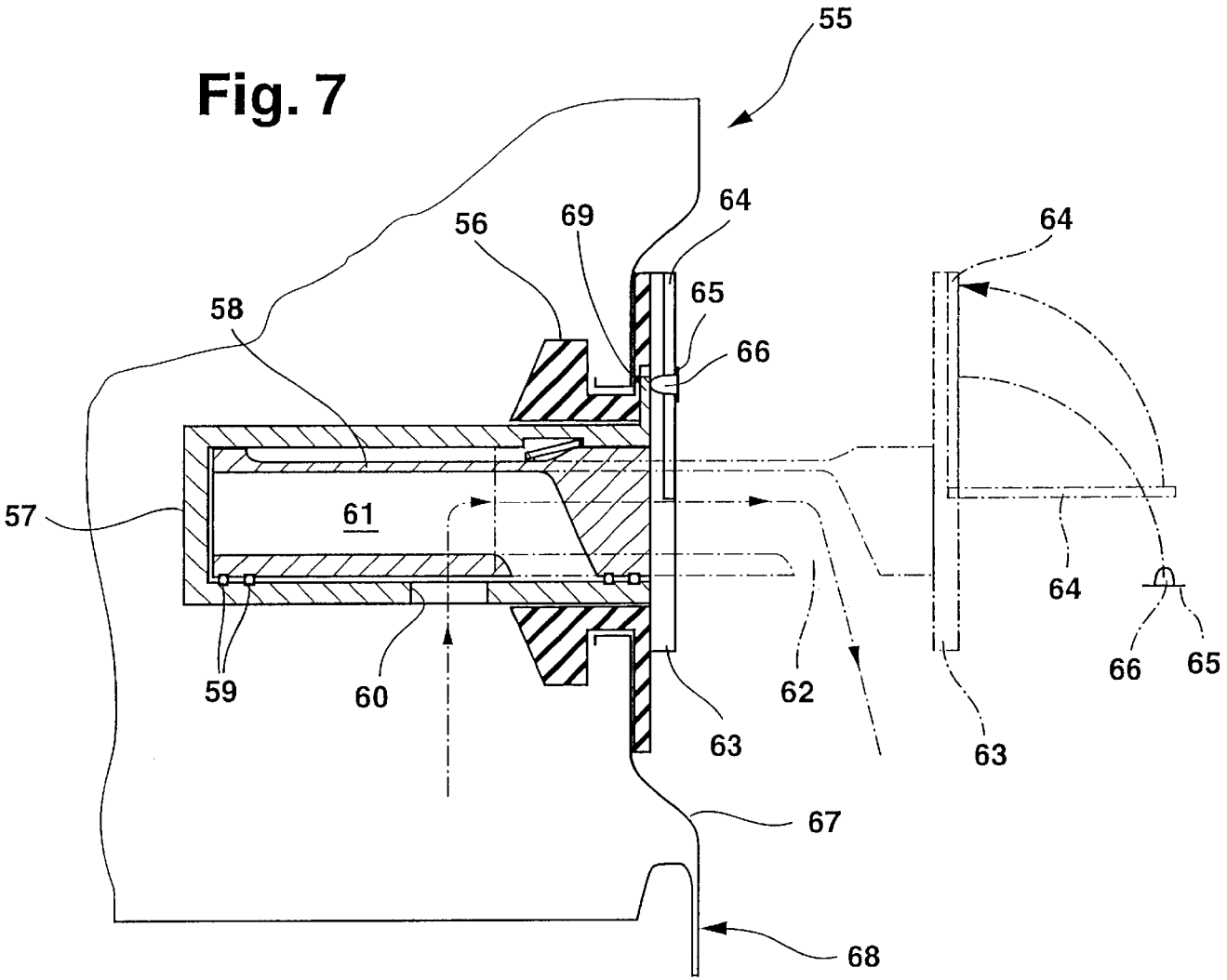
FIG. 7 shows a cross-section through an additional embodiment of a tap which is opened with a translational motion and which has a seal.

FIG. 7 shows a cross-section through an additional embodiment of a tap opened by a translational motion. The tap is inserted into a recess 67 of a party keg 55 and consists essentially of an outer pipe 57 closed at the inside and firmly anchored in a seal 56 which is, in turn, firmly anchored in a hole of the party keg 55. An inner tube 58 is disposed inside the inner volume of the outer tube 57 and is sealed at its back end in a peripheral fashion with respect to the outer tube 57 by at least one seal 59. The outer tube 57 has a radial bore 60 for the passage of fluid into the inside of the outer tube 57. The inner tube 58 is open at its back end for entrance of fluid into the inner tube 58. The inner tube 58 also has a radially diagonal output opening 62.

The forward end of the inner tube 58 has an outer flange 63 which seats outside of the party keg 55 within the recess 67 of the outer wall of the keg in the closed state of the tap. A grip 64 is fashioned into the surface of the flange 63 which, for example, consists essentially of a tab 64 which can be bent through 90 degrees and which is connected at one side to the flange 63. The tab 64 is secured by means of a seal 65 which projects through a hole 77 in the tab 64 and a hole 70 in the flange 63. The end of the seal is firmly connected to the material of the outer tube 57. The outer tube 57 has e.g. in this region a shoulder seating outside of the liquid container 55 or a flange 69 at which the seal 65 seats at its end 66 and is firmly connected to the material of the outer tube 57 at this location.

When the tab 64 is pulled in the forward direction, the seal 65 breaks at its intended breaking location 66 away from the flange 69 of the outer tube 57 so that the first opening of the tap is visible. The tab 64 can then be extended through 90 degrees towards the longitudinal axis of the tap and the inner tube 58 can be pulled out from the outer tube 57. As soon as the back open end of the inner tube 58 passes by the radial bore 60 of the outer tube 57, the fluid located within the party keg flows outwardly.

Figure 8B:
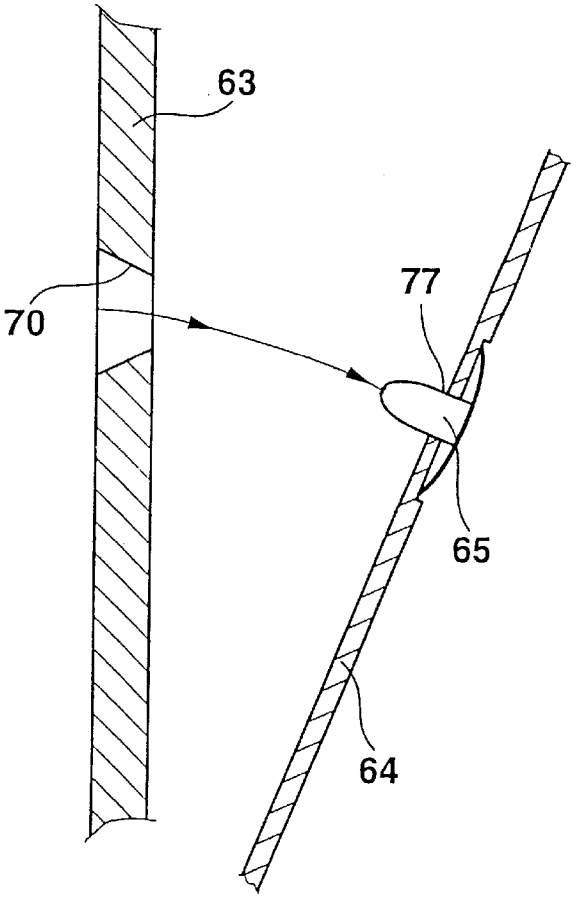
FIGS. 8A and 8B show an enlargement of the seal region of FIG. 7
Figure 8A:
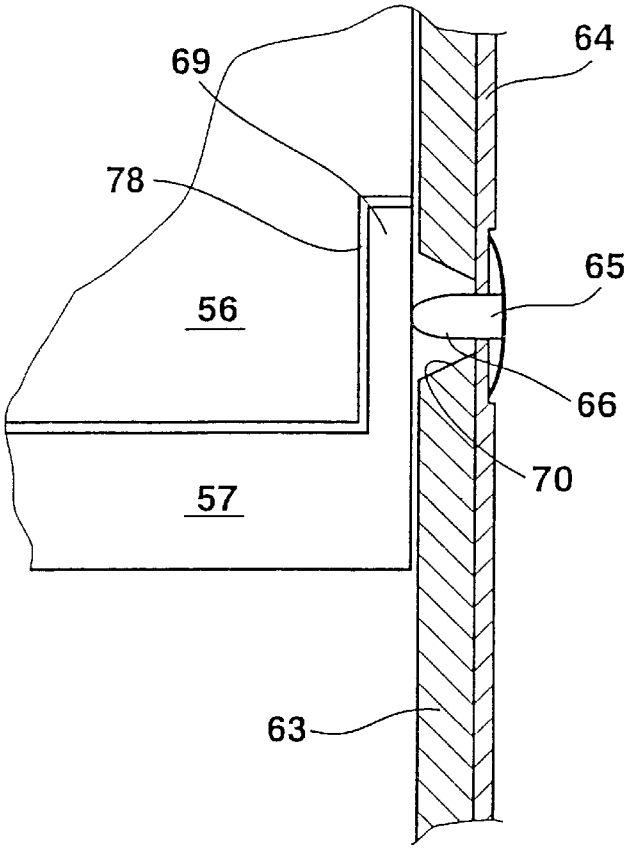

FIG. 8 shows an enlarged view of the position of the sealing ring 56 with respect to the flange 69 of the outer tube 57 and the seal 65 seating thereon. The flange 69 is disposed in a recess 78 of the seal 56 and the surface of the flange 69 is coplanar with the surface of the seal 56. The seal 65 is firmly connected to the flange 69 of the outer tube 57 and has an intended breaking location 66 at the end seating on the flange 69. The seal 65 is inserted through a hole 77 in the grip 64 as well as a hole 70 in the flange 63 of the inner tube 58.

Figure 9:
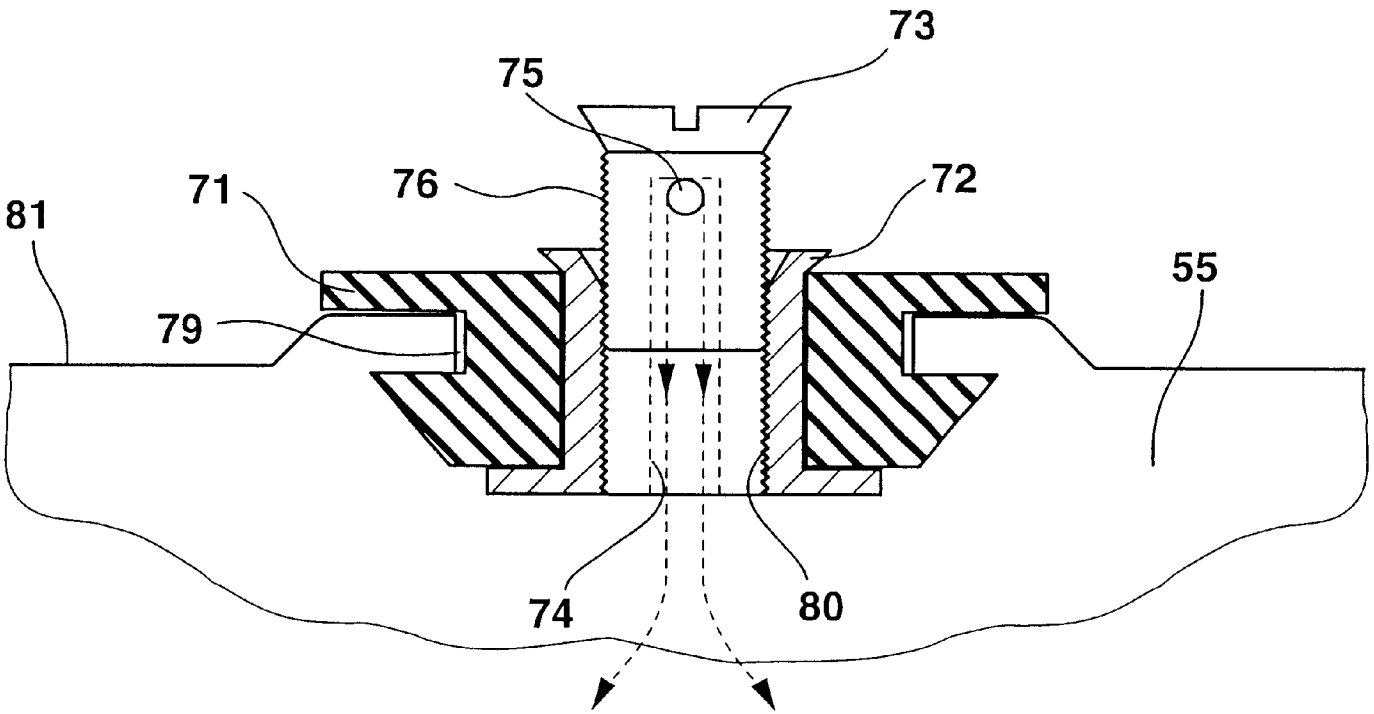
FIG. 9 shows an additional vent valve for venting the liquid container.

FIG. 9 shows an additional vent valve for venting the liquid container 55. The vent valve is disposed in a hole 79 of a lid 81 of the liquid container 55 and consists essentially of a ring-shaped seal 71 into which a likewise ring-shaped sealing stopper 72, having an inner thread 80, is pressed. A tubular valve 73 having an outer thread 76 is screwed in a gas-tight fashion into the inner thread 80 and has a longitudinal bottom hole 74 facing in an inward direction and having a transverse bore 75 at its upper end. When the valve 73 is screwed out of the sealing stopper 72, the transverse bore 75 is freed and the liquid container 55 vented.

I claim:

1. Tap for a liquid container for drinks such as cans, a party keg made from sheet metal, aluminum or plastic, the tap comprising:

an outer tube having an inlet;

an inner tube disposed within said outer tube for displacement relative to said outer tube, said inner tube having a side wall, an end wall, and a longitudinal channel with an inlet and an outlet, said channel inlet communicating with said outer tube inlet only when said inner tube is pulled out of said outer tube to dispense the liquid in the container;

a grip disposed on said inner tube for pulling said inner tube out of said outer tube, said grip having an opening;

a flange member integral with said outer tube; and a seal mounted to said flange member, said seal protruding into said grip opening and cooperating with said grip, said seal being configured for breaking off when said grip first pulls said inner tube out of said outer tube.

2. The tap of claim 1, wherein said inner tube has a guide groove travelling in a helical manner about an outside of said inner tube, and further comprising a guide pin mounted to said outer tube and projecting into said guide groove.

3. The tap of claim 2, wherein said guide groove extends through 360 degrees about said inner tube.

4. The tap of claim 1, wherein said channel inlet is disposed in said end wall.

5. The tap of claim 1, wherein said channel inlet is disposed in said side wall.

6. The tap of claim 1, wherein said outer tube comprises an inlet connector inserted into said outer tube inlet perpendicular to said outer tube.

7. Liquid container for drinks such as cans, a party keg made from sheet metal, aluminum or plastic, the liquid container comprising:

a housing having a wall and a lid; and a tap, said tap comprising an outer tube having an inlet, an inner tube disposed within said outer tube for displacement relative to said outer tube, said inner tube having a side wall, an end wall, and a longitudinal channel with an inlet and an outlet, said channel inlet communicating with said outer tube inlet only when said inner cube is pulled out of said outer tube to dispense the liquid in the container, a grip disposed on said inner tube for pulling said inner tube out of said outer tube, said grip having an opening, a flange member integral with said outer tube, a seal mounted to said flange member, said seal protruding into said grip opening and cooperating with said grip, said seal being configured for breaking off said seal when said grip first pulls said inner tube out of said outer tube.

8. The container of claim 7, wherein said outer tube is inserted into a hole in said housing wall and further comprising a seal member surrounding said outer tube and disposed between said outer tube and said housing wall hole.

9. The container of claim 7, further comprising a venting device.

10. The container of claim 9, wherein said venting device is a vent valve disposed in said lid of the liquid container.

11. Tap for a liquid container for drinks such as cans, a party keg made from sheet metal, aluminum or plastic, the tap comprising:

an outer tube having an inlet;

an inner tube disposed within said outer tube for displacement relative to said outer tube, said inner tube having a side wall, an end wall, and a longitudinal channel with an inlet and an outlet, said channel inlet communicating with said outer tube inlet only when said inner tube is pulled out of said outer tube to dispense the liquid in the container;

a grip disposed on said inner tube for pulling said inner tube out of said outer tube, said grip having an opening;

a flange member integral with said outer tube; and a seal mounted to said flange member, said seal protruding into said grip opening and cooperating with said grip, said seal being configured for breaking off when said grip first rotates said inner tube out of said outer tube.

12. Liquid container for drinks such a cans, a party keg made from sheet metal, aluminum or plastic, the liquid container comprising:

a housing having a wall and a lid; and a tap, said tap comprising an outer tube having an inlet, an inner tube disposed within said outer tube for displacement relative to said outer tube, said inner tube having a side wall, an end wall, and a longitudinal channel with an inlet and an outlet, said channel inlet communicating with said outer tube inlet only when said inner tube is pulled out of said outer tube to dispense the liquid in the container, a grip disposed on said inner tube for pulling said inner tube out of said outer tube, said grip having an opening, a flange member integral with said outer tube, a seal mounted to said flange member, said seal protruding into said grip opening and cooperating with said grip, said seal being configured for breaking off said seal when said grip first rotates said inner tube out of said outer tube.

* * * * *

UNITED STATES PATENT AND TRADEMARK OFFICE

CERTIFICATE OF CORRECTION

PATENT NO. : 6,260,823 B1
DATED : July 17, 2001
INVENTOR(S) : Weber, Hans-Joachim It is certified that error appears in the above-identified patent and that said Letters Patent is hereby corrected as shown below:

Title page,
Please replace "[73] Assignee: Huber Verpackungen GmbH & Co. KG Dehringen (DE)" with -- [73] Assignee: Huber Verpackungen GmbH & Co. KG Oehringen (DE) --.

Signed and Sealed this

Twenty-eighth Day of May, 2002

*Attest:*

*Attesting Officer*

JAMES E. ROGAN
*Director of the United States Patent and Trademark Office*